US009970174B2

(12) United States Patent
Formenti et al.

(10) Patent No.: US 9,970,174 B2
(45) Date of Patent: May 15, 2018

(54) SILENCER FOR SILENCING PILE DRIVING INTO THE BED OF A BODY OF WATER, AND PILE DRIVING SYSTEM AND METHOD

(71) Applicant: SAIPEM S.p.A., San Donato Milanese (IT)

(72) Inventors: Massimiliano Formenti, San Donato Milanese (IT); Nicola Bassetto, San Donato Milanese (IT)

(73) Assignee: SAIPEM S.P.A., San Donato Milanese (IT)

( * ) Notice: Subject to any disclaimer, the term of this patent is extended or adjusted under 35 U.S.C. 154(b) by 0 days. days.

(21) Appl. No.: 15/023,982

(22) PCT Filed: Sep. 25, 2014

(86) PCT No.: PCT/IB2014/064839
§ 371 (c)(1),
(2) Date: Mar. 22, 2016

(87) PCT Pub. No.: WO2015/044897
PCT Pub. Date: Apr. 2, 2015

(65) Prior Publication Data

US 2016/0244934 A1 Aug. 25, 2016

(30) Foreign Application Priority Data

Sep. 25, 2013 (IT) ..... MI2013A1581

(51) Int. Cl.
*E02D 13/00* (2006.01)
*E02D 7/06* (2006.01)
*E02D 27/52* (2006.01)

(52) U.S. Cl.
CPC ..... *E02D 13/005* (2013.01); *E02D 7/06* (2013.01); *E02D 13/00* (2013.01); *E02D 27/525* (2013.01)

(58) Field of Classification Search
USPC ..... 405/228, 231, 232
See application file for complete search history.

(56) References Cited

U.S. PATENT DOCUMENTS 5,161,625 A * 11/1992 Seng ..... E02D 7/16 173/53
2002/0080681 A1 6/2002 Dreyer et al.
(Continued)

FOREIGN PATENT DOCUMENTS

DE 101 17 109 12/2002
DE 103 02 219 9/2004
(Continued)

OTHER PUBLICATIONS

International Search Report and Written Opinion for International Application No. PCT/IB2014/064839 dated Dec. 16, 2014.
(Continued)

*Primary Examiner* — Sean D Andrish
(74) *Attorney, Agent, or Firm* — Neal, Gerber & Eisenberg LLP

(57) ABSTRACT

A silencer for silencing the driving of piles into the bed of a body of water is configured to fit around a pile, and has a first tube; a second tube inserted inside and spaced apart from the first tube, both the first and second tube being longer than the depth of the bed of the body of water on which they are to rest; and a bottom wall, which is joined hermetically to respective ends of the first and second tube to form a gap between the first and second tube, and is configured to rest on the bed of the body of water.

14 Claims, 4 Drawing Sheets

(56) References Cited

U.S. PATENT DOCUMENTS

| | | | | |
|---|---|---|---|---|
| 2011/0031062 | A1 | 2/2011 | Elmer | |
| 2012/0097476 | A1* | 4/2012 | Jung | E02D 7/14 181/196 |
| 2012/0107055 | A1* | 5/2012 | Baumfalk | E02B 17/0004 405/228 |
| 2013/0001010 | A1 | 1/2013 | Wilson et al. | |
| 2013/0011203 | A1* | 1/2013 | Reinhall | E02D 5/24 405/228 |

FOREIGN PATENT DOCUMENTS

| | | | |
|---|---|---|---|
| EP | 2 402 511 | | 1/2012 |
| WO | WO 2010/151121 | | 12/2010 |
| WO | WO 2011091041 | * | 7/2011 |

OTHER PUBLICATIONS

Notification Concerning Submission, Obtention or Transmittal of Priority Document (Form PCT/IB/304) for International Application No. PCT/IB2014/064839 dated Nov. 14, 2014.

Response to International Search Report and the associated Written Opinion for International Application No. PCT/IB2014/064839 dated Jul. 17, 2015.

PCT Demand (Form PCT/IPEA/401) for International Application No. PCT/IB2014/064839.

Notification of Receipt of Demand by Competent International Preliminary Examining Authority (Form PCT/IPEA/402) for International Application No. PCT/IB2014/064839 dated Jul. 27, 2015.

Written Opinion of the International Preliminary Examining Authority (Form PCT/IPEA/408) for International Application No. PCT/IB2014/064839 dated Sep. 10, 2015.

Second Response to International Search Report and the associated Written Opinion for International Application No. PCT/IB2014/064839 dated Nov. 9, 2015.

Notification of Transmittal of the International Preliminary Report on Patentability (Form PCT/IPEA/416) for International Application No. PCT/IB2014/064839 dated Dec. 21, 2015.

International Preliminary Report on Patentability (Form PCT/IPEA/409) for International Application No. PCT/IB2014/064839 dated Dec. 21, 2015.

* cited by examiner

SILENCER FOR SILENCING PILE DRIVING INTO THE BED OF A BODY OF WATER, AND PILE DRIVING SYSTEM AND METHOD

PRIORITY CLAIM

This application is a national stage application of PCT/IB2014/064839, filed on Sep. 25, 2014, which claims the benefit of and priority to Italian Patent Application No. MI2013A 001581, filed on Sep. 25, 2013, the entire contents of which are each incorporated by reference herein.

BACKGROUND

Driving piles into the bed of a body of water produces a high level of noise in the surrounding environment. The noise increases alongside an increase in the diameter of the piles and in the depth of the bed of the body of water, to the point of exceeding the threshold tolerated by Cetacea and Pinnipedia. For this reason, some countries have imposed a maximum noise threshold. For example, the threshold imposed by the German government is 160 dB re 1 μPa at a distance of 750 meters.

One way of reducing noise is to use a contact damper between the free end of the pile and the pile driver. That is, the contact damper acts as a shock-absorber, which reduces the force of impact and, with the reduced force, the noise level by roughly 5-10 dB. Using this solution, however, more blows are needed to drive in the pile.

Another way of reducing noise is to alter the operating parameters of the pile driver and, more specifically, to prolong the time the pile driver ram remains in contact with the pile, so as to reduce vibration of, and the noise produced by the pile. This solution, however, also has the drawback of requiring more blows to drive in the pile.

Another pile driving noise abatement solution currently being researched is to generate air bubbles around the pile.

A few examples of noise abatement techniques are described in U.S. Published Patent Application No. 2002080681, U.S. Published Patent Application No. 2011031062, U.S. Published Patent Application No. 2013001010, German Patent No. 10302219 and German Patent No. 10117109.

PCT Patent Application No. WO 2010/151121 discloses a double walled device for the passive reduction of the sound vibrations in a liquid resulting from a sound source arranged below the liquid level of a body of water. The double walled device defines a sealed intermediate space between the walls and is inserted into the body of water via adjustable anchors.

SUMMARY

The present disclosure relates to a silencer configured to silence pile driving into the bed of a body of water.

It is an advantage of the present disclosure to provide a relatively simple, relatively easy-to-use silencer that is relatively highly effective in reducing noise produced by driving piles into the bed of a body of water.

According to the present disclosure, there is provided a silencer configured to silence pile driving into the bed of a body of water, the silencer being configured to fit around a pile, and comprising a first tube longer than the depth of the bed of the body of water; a second tube, which is inserted inside and spaced apart from the first tube, and is longer than the depth of the bed of the body of water; a bottom wall, which is joined hermetically to the first and second tube to form a gap between the first and second tube, and is configured to rest on the bed of the body of water; and an open top end from which to release sound waves from the gap. This way, the silencer forms, in a relatively straightforward, practical manner, an air gap between the noise source—the pile—and the surrounding marine environment. Moreover, sheathing the pile with the silencer (i.e., fitting the silencer fairly accurately around the pile) enables the silencer to support the pile in an upright position or, vice versa, the pile to support the silencer. The silencer and the pile are connected to each other accurately enough to ensure mutual support and alignment, while at the same time enabling the pile to slide with respect to the silencer.

In certain embodiments, the first and second tube each have a circular cross section; the first and second tube being concentric with each other. This way, the gap is of constant thickness in all radial, potential noise-propagating directions.

In certain embodiments, the silencer comprises elastic spacers between the first and second tube. The elastic spacers maintain a constant thickness of the gap. And the elasticity of the spacers dampens vibration transmission between the first and second tube. In certain such embodiments, construction-wise, each spacer comprises a block of elastomer material.

In another embodiment of the present disclosure, the silencer comprises further elastic spacers projecting radially inwards of the second tube to prevent direct contact between the pile and the second tube. This provides for maintaining a constant distance and damping vibration transmission between the pile and the second tube, and enables mutual support of the pile and the silencer. In this case, too, each spacer comprises a block of elastomer material.

In certain embodiments, the bottom wall is annular, with a centre opening for passage of the pile.

In certain embodiments of the present disclosure, the bottom wall projects radially beyond the second tube.

The bottom wall thus provides a relatively ample supporting area for greater stability.

In certain embodiments, the silencer comprises at least one ballast member located on the bottom wall. In certain such embodiments, the ballast member is located on top of the projecting portion of the bottom wall. This ensures relatively greater stability of the silencer.

Construction-wise, the first and second tube and the bottom wall are made of metal.

In certain embodiments, the silencer has an open top end from which to release sound waves from the gap. This provides for further reducing vibration between the first and second tube.

A further advantage of the present disclosure is to provide a pile-driving system configured to eliminate certain of the drawbacks of certain of the known art.

According to the present disclosure, there is provided a system configured to drive piles into the bed of a body of water, the system comprising a pile driving machine; and at least one silencer of the type described above.

One silencer employed together with the pile driving machine can thus be used for a plurality of piles. In fact, the pile and the silencer, when placed around the pile, substantially define an elongated structure, in which the pile slides with respect to the silencer along the pile axis, and the silencer rests on the bed.

A further advantage of the present disclosure is to provide a method of driving piles into the bed of a body of water, configured to eliminate certain of the drawbacks of certain of the known art.

According to the present disclosure, there is provided a method of driving piles into the bed of a body of water, the method comprising the steps of resting a silencer, having at least one of the characteristics described above, on the bed of a body of water; resting a pile on the bed of the body of water and inside the silencer; and driving the pile a predetermined depth into the bed of the body of water.

In certain embodiments, the method comprises withdrawing the silencer from the pile.

In certain embodiments of the present disclosure, the method comprises supporting the silencer using the pile located inside the silencer.

Additional features and advantages are described in, and will be apparent from the following Detailed Description and the figures.

BRIEF DESCRIPTION OF THE DRAWINGS

A non-limiting embodiment of the present disclosure will be described by way of example with reference to the attached drawings, in which.

DETAILED DESCRIPTION

Figure 1:
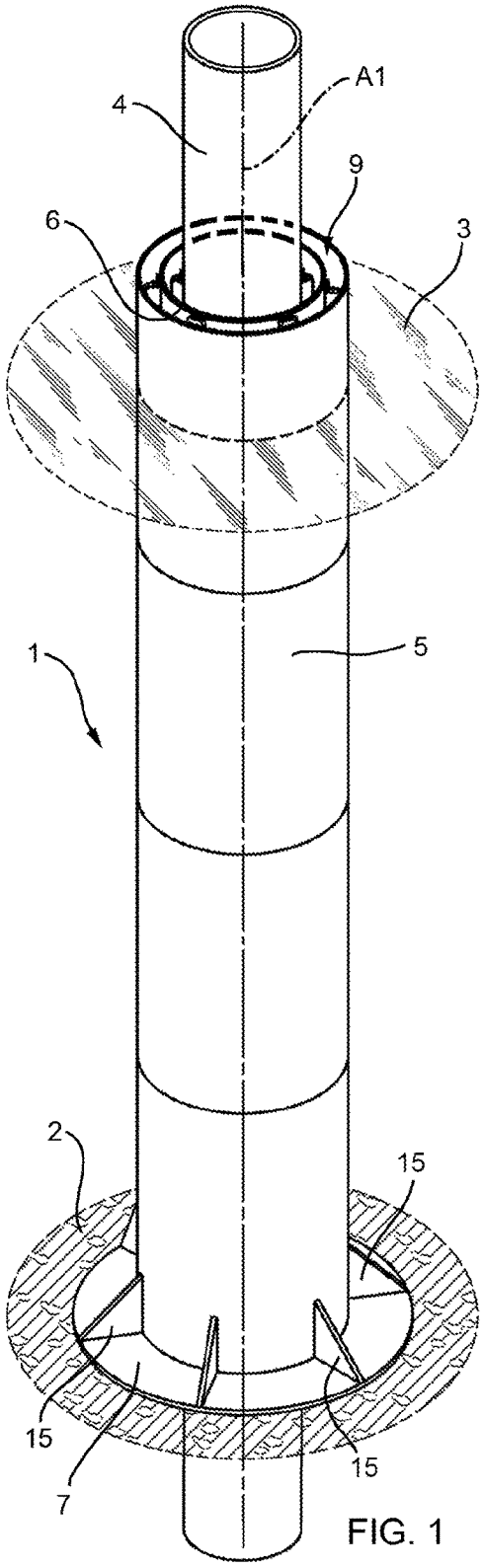
FIG. 1 shows a view in perspective, with parts removed for clarity, of a silencer in accordance with the present disclosure.
Figure 2:
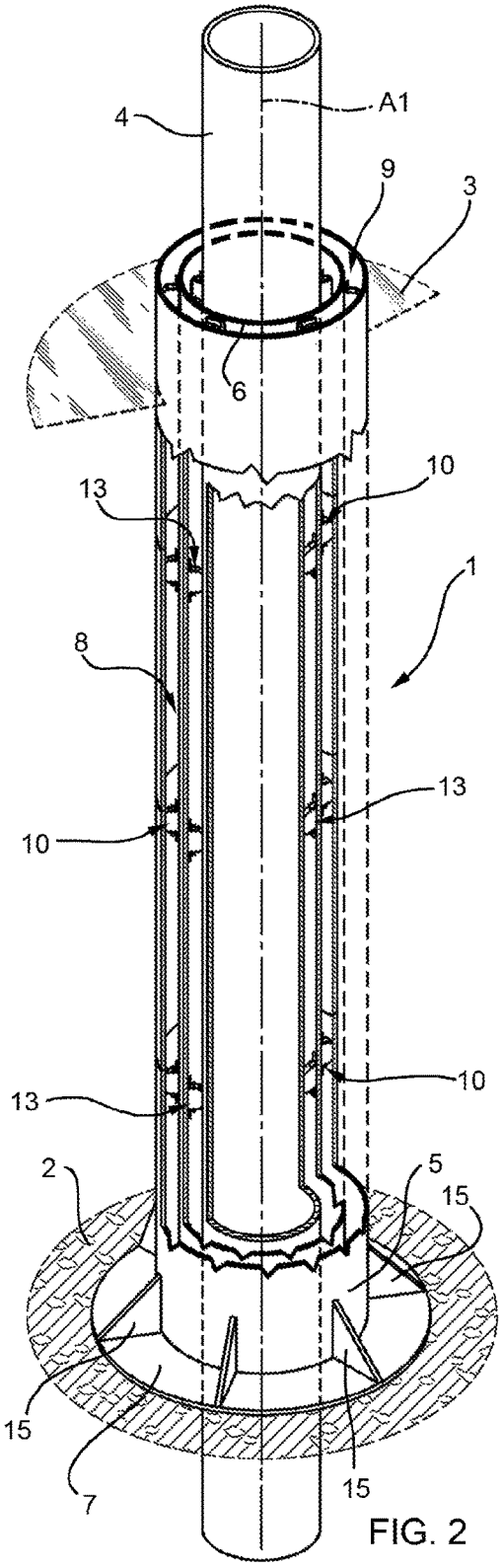
FIG. 2 shows a partly sectioned view in perspective, with parts removed for clarity, of the FIG. 1 silencer.

Referring now to the example embodiments of the present disclosure illustrated in FIGS. 1 to 7, number 1 in FIGS. 1 and 2 indicates a silencer extending along an axis A1. Silencer 1 is positioned resting on the bed 2 of a body of water 3 to prevent or reduce the propagation of sound waves into the body of water 3 when driving piles 4 into bed 2 of body of water 3. Silencer 1 is fitted about pile 4, and is longer than the depth of bed 2 of body of water 3.

Piles 4 are normally foundation piles of such a length that, even when driven into bed 2 of body of water 3, a top end of each pile projects from body of water 3.

Silencer 1 comprises a tube 5 longer than the depth of bed 2 of body of water 3; a tube 6, which is inserted inside and spaced apart from tube 5, is longer than the depth of bed 2 of body of water 3, and is configured to fit around pile 4; and a bottom wall 7, which is joined hermetically to tubes 5 and 6 to form a gap 8 between tubes 5 and 6, and is configured to rest on bed 2 of body of water 3. Gap 8 is full of air.

In the illustrated embodiment, silencer 1 has an open top end 9 (which is in fluid communication with a portion of the bottom wall) through which any sound waves inside gap 8 are expelled from body of water 3.

Figure 4:
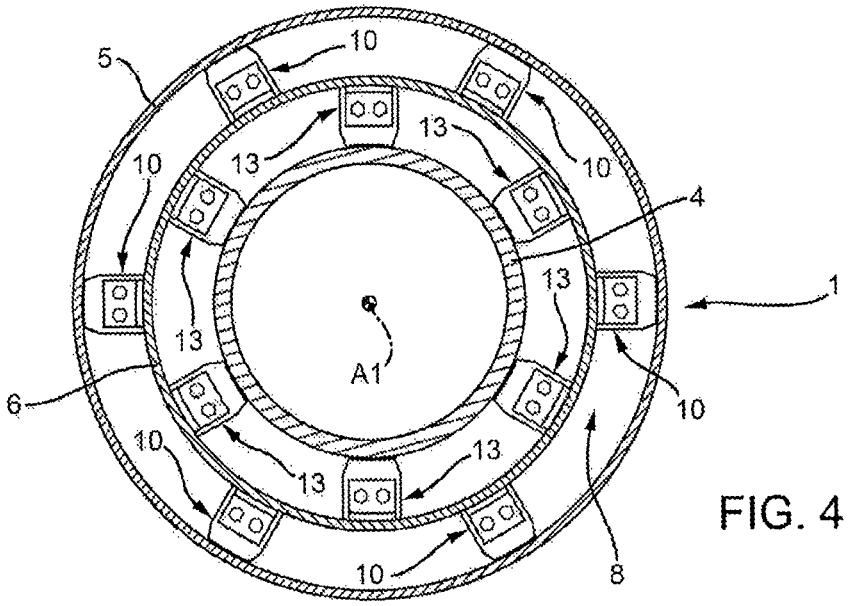
FIG. 4 shows a cross section, with parts removed for clarity, of the FIG. 1 silencer along line IV-IV in FIG. 3.

In the example shown, tubes 5 and 6 each have a circular cross section and are substantially concentric, as shown more clearly in FIG. 4.

Figure 5:
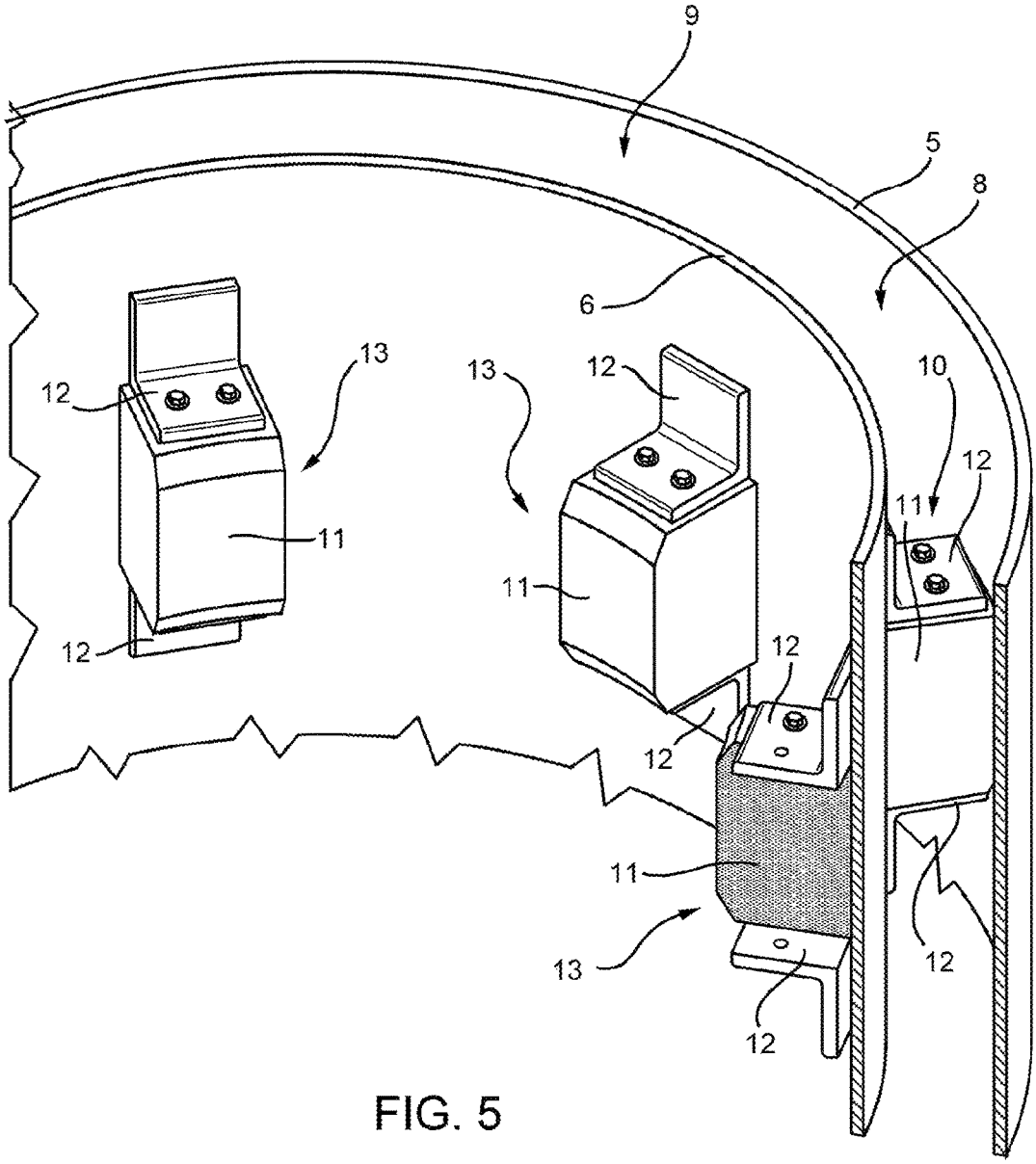
FIG. 5 shows a larger-scale view in perspective, with parts removed for clarity, of a detail of the FIG. 1 silencer.

With reference to FIG. 5, silencer 1 comprises spacers 10 between tubes 5 and 6. In certain embodiments, spacers 10 are elastic and each comprise a block 11 of elastomer material, and two brackets 12 configured to support block 11. Spacers 10 are fitted to, and project radially outwards of, tube 6.

In the example shown, spacers 10 are equally spaced axially and circumferentially on the outer face of tube 6.

Silencer 1 comprises further spacers 13 along the inner face of tube 6, to keep tube 6 a given or designated distance from pile 4.

Spacers 13 are substantially identical to spacers 10, and each comprise a block 11 of elastomer material, and two brackets 12 configured to support block 11.

Spacers 13 are fitted to, and project radially inwards of, tube 6.

In the example shown, spacers 13 are equally spaced axially and circumferentially on the inner face of tube 6.

Figure 3:
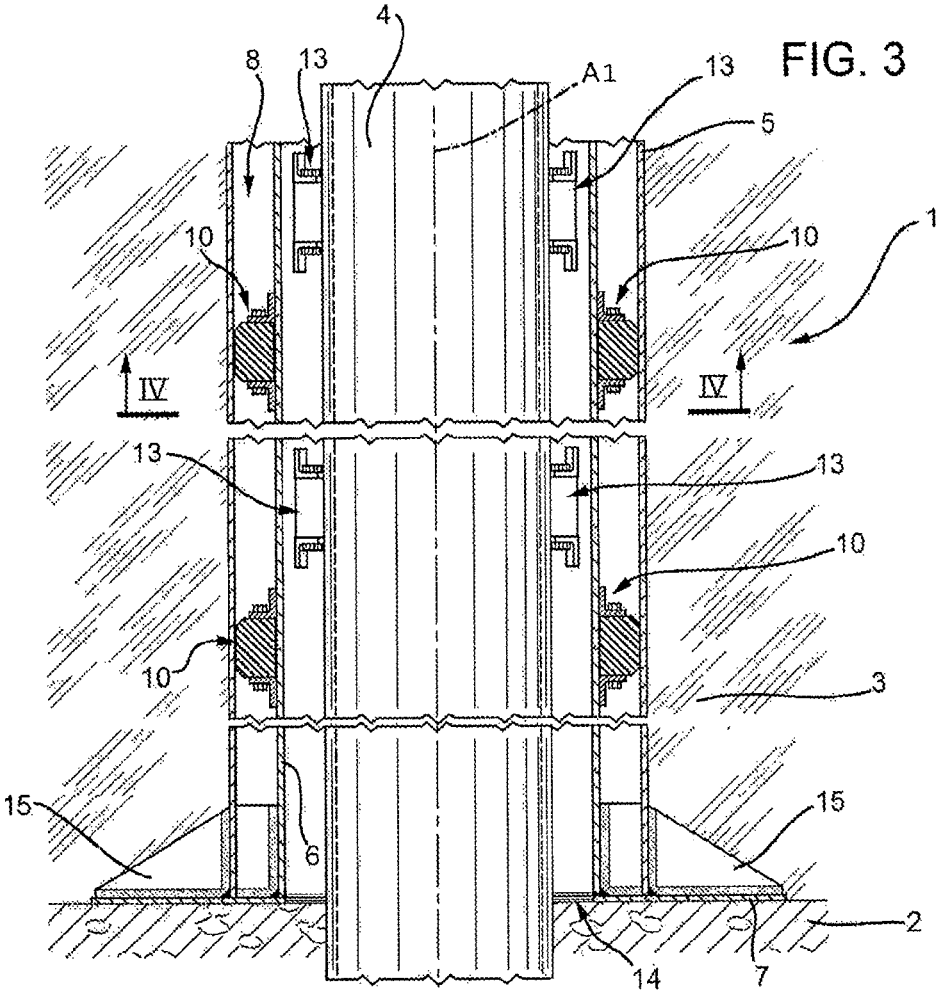
FIG. 3 shows a larger-scale longitudinal section, with parts removed for clarity, of the FIG. 1 silencer.

With reference to FIG. 3, bottom wall 7 is annular with a central opening 14 for passage of pile 4. Bottom wall 7 projects radially beyond tube 6. The projecting part of bottom wall 7 is connected to tube 6 by reinforcing brackets 15. In actual use, bottom wall 7 is positioned resting on bed 2, and the projecting part of bottom wall 7 may be used to house ballast 16 as shown in FIGS. 6 and 7.

Tubes 5 and 6 and bottom wall 7 are generally made of metal.

Figure 6:
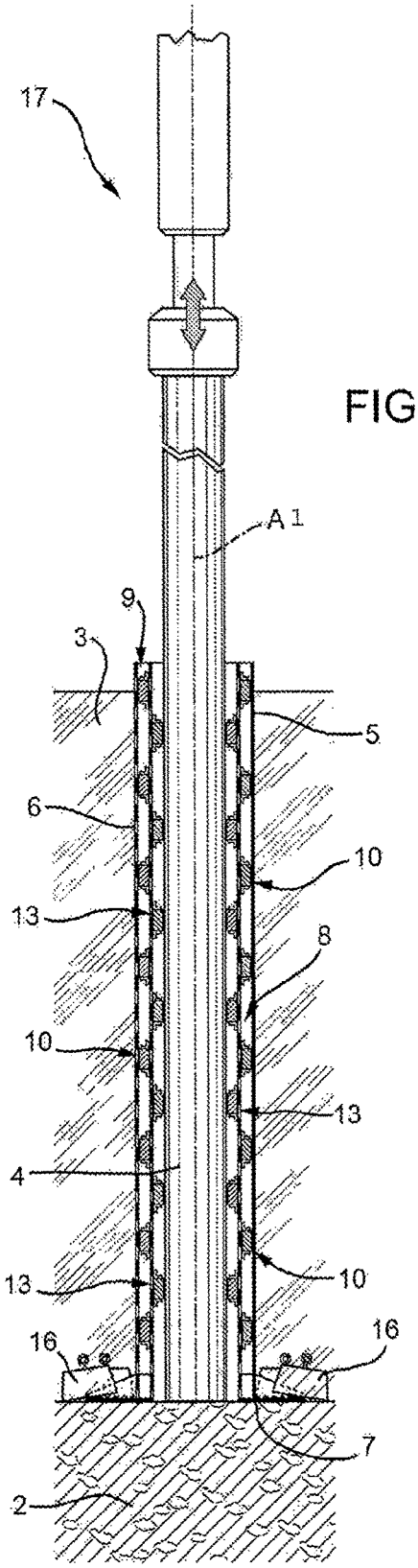
FIGS. 6 and 7 show partly sectioned elevations, with parts removed for clarity, of successive pile driving stages.
Figure 7:
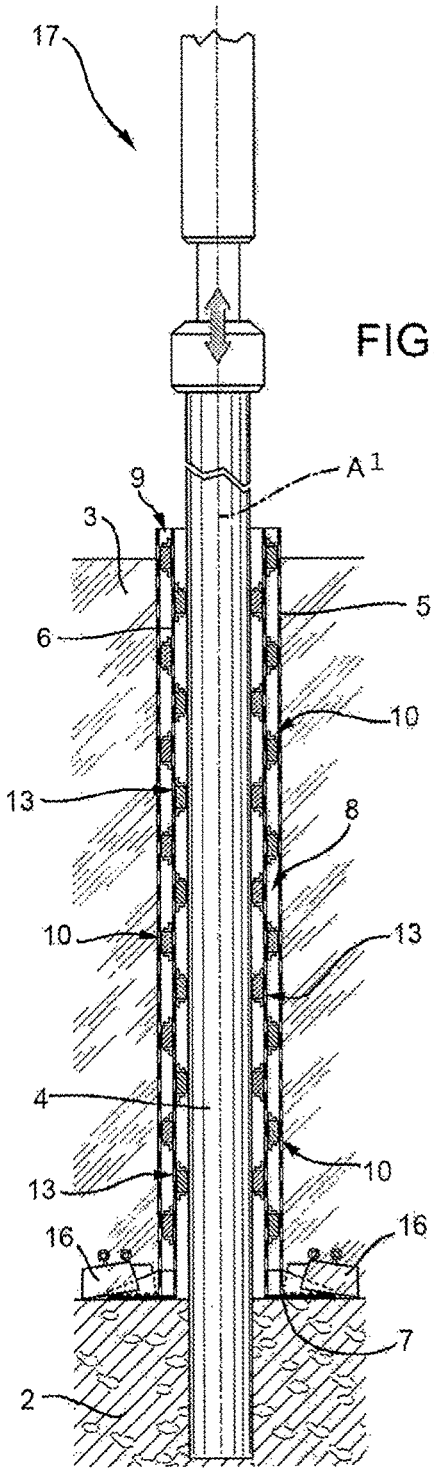

With reference to FIGS. 6 and 7, silencer 1 forms part of a system configured to drive piles 4 into the bed 2 of a body of water 3. The system comprises a pile driving machine 17, and at least one silencer 1.

Silencer 1 is supported by pile 4.

In actual use, pile driving into the bed 2 of a body of water 3 comprises resting a silencer 1 on bed 2 of body of water 3; resting a pile 4 on bed 2 of body of water 3 and inside silencer 1; and driving pile 4 a predetermined depth into bed 2 of body of water 3.

Silencer 1 is then recouped by removing silencer 1 from pile 4 supporting silencer 1.

In addition to effectively damping sound waves emitted when driving pile 4, silencer 1 actually also serves as a sort of coupling enabling axial slide of pile 4, and supports pile 4 in a vertical position. Conversely, pile 4, if otherwise supported, may effectively support silencer 1.

Clearly, changes may be made to the embodiment described of the present disclosure without, however, departing from the protective scope of the accompanying Claims. That is, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A pile driving silencer comprising:

a first tube;

a second tube which is: (i) inside the first tube, (ii) spaced apart from the first tube, and (iii) configured to fit around a pile to be driven into a bed of a body of water;

a bottom wall configured to rest on the bed of the body of water, wherein said bottom wall is hermetically joined to a bottom end of the first tube and a bottom end of the second tube such that a gap extends between the first tube and the second tube;

at least one ballast member located on top of a projecting portion of the bottom wall; and an open top end in fluid communication with a portion of the bottom wall and from which to release sound waves from the gap to an area above the body of water.

2. The pile driving silencer of claim 1, wherein the first tube and the second tube each have a circular cross section and the first and the second tube are concentric with each other.

3. The pile driving silencer of claim 1, which includes a plurality of elastic spacers located between the first tube and the second tube.

4. The pile driving silencer of claim 3, wherein each elastic spacer includes a block of elastomer material.

5. The pile driving silencer of claim 1, which includes a plurality of elastic spacers which project radially inwards of the second tube to prevent direct contact between the pile and the second tube.

6. The pile driving silencer of claim 5, wherein each elastic spacer including a block of elastomer material.

7. The pile driving silencer of claim 1, wherein the bottom wall is annular, and defines a center opening for passage of the pile.

8. The pile driving silencer of claim 1, wherein the bottom wall radially projects beyond the second tube.

9. The pile driving silencer of claim 1, wherein the first tube, the second tube, and the bottom wall are made of metal.

10. The pile driving silencer of claim 1, wherein the first tube is longer than a depth of the body of water.

11. The pile driving silencer of claim 10, wherein the second tube is longer than the depth of the body of water.

12. A pile driving system comprising:

a pile driving machine; and a pile driving silencer including:

a first tube;

a second tube which is: (i) inside the first tube, (ii) spaced apart from the first tube, and (iii) configured to fit around a pile to be driven into a bed of a body of water;

a bottom wall configured to rest on the bed of the body of water, wherein said bottom wall is hermetically joined to a bottom end of the first tube and a bottom end of the second tube such that a gap extends between the first tube and the second tube;

at least one ballast member located on top of a projecting portion of the bottom wall; and an open top end in fluid communication with a portion of the bottom wall and from which to release sound waves from the gap to an area above the body of water.

13. The pile driving system of claim 12, wherein the first tube of the pile driving silencer is longer than a depth of the body of water.

14. The pile driving system of claim 13, wherein the second tube of the pile driving silencer is longer than the depth of the body of water.

* * * * *